US010026407B1

(12) United States Patent
Boucheron et al.

(10) Patent No.: US 10,026,407 B1
(45) Date of Patent: Jul. 17, 2018

(54) LOW BIT-RATE SPEECH CODING THROUGH QUANTIZATION OF MEL-FREQUENCY CEPSTRAL COEFFICIENTS

(71) Applicant: Arrowhead Center, Inc., Las Cruces, NM (US)

(72) Inventors: Laura E. Boucheron, Las Cruces, NM (US); Phillip L. De Leon, Las Cruces, NM (US); Steven Sandoval, Las Cruces, NM (US)

(73) Assignee: Arrowhead Center, Inc., Las Cruces, NM (US)

( * ) Notice: Subject to any disclaimer, the term of this patent is extended or adjusted under 35 U.S.C. 154(b) by 0 days.

(21) Appl. No.: 15/495,452

(22) Filed: Apr. 24, 2017

Related U.S. Application Data

(63) Continuation of application No. 13/329,976, filed on Dec. 19, 2011, now abandoned.
(Continued)

(51) Int. Cl.
*G10L 19/02* (2013.01)
*G10L 19/00* (2013.01)
(Continued)

(52) U.S. Cl.
CPC ..... *G10L 19/0018* (2013.01); *G10L 19/0212* (2013.01); *G10L 19/032* (2013.01); *G10L 25/24* (2013.01)

(58) Field of Classification Search
USPC ..... 704/203–207, 222, 230
See application file for complete search history.

(56) References Cited

U.S. PATENT DOCUMENTS 5,165,008 A 11/1992 Hermansky et al.
5,260,939 A * 11/1993 Suda ..... H04L 1/0083 370/435
(Continued)

OTHER PUBLICATIONS

Boucheron, et al., "Hybrid ScalarNector Quantization of Mel-Frequency Cepstral Coefficients for Low Bit-Rate Coding of Speech", 2011 Data Compression Conference, Mar. 29-31, 2011.
(Continued)

*Primary Examiner* — Leonard Saint Cyr
(74) *Attorney, Agent, or Firm* — Jeffrey D. Myers; Justin R. Jackson; Peacock Law P.C.

(57) ABSTRACT

A method of (and concomitant computer software embodied on a non-transitory computer-readable medium for) generating speech comprising receiving a mel-frequency cepstrum employing a set of weighting functions, generating a pseudo-inverse of the set, reconstructing a speech waveform from the cepstrum and the pseudo-inverse, and outputting sound corresponding to the waveform. Also a corresponding method of (and concomitant computer software embodied on a non-transitory computer-readable medium for) encoding speech comprising receiving sounds comprising speech, computing mel-frequency cepstral coefficients from the sounds using a quantization method selected from the group consisting of non-uniform scalar quantization and vector quantization, and generating and storing codewords from the coefficients that permit recreation of the sounds.

8 Claims, 5 Drawing Sheets

Related U.S. Application Data

(60) Provisional application No. 61/424,525, filed on Dec. 17, 2010.

(51) Int. Cl.
*G10L 19/032* (2013.01)
*G10L 25/24* (2013.01)

(56) References Cited

U.S. PATENT DOCUMENTS

| | | | | |
|---|---|---|---|---|
| 5,305,332 | A * | 4/1994 | Ozawa | G10L 19/005 704/219 |
| 6,092,039 | A | 7/2000 | Zingher | |
| 6,199,041 | B1 | 3/2001 | Liu et al. | |
| 6,256,607 | B1 | 7/2001 | Digalakis et al. | |
| 6,311,153 | B1 | 10/2001 | Nakatoh et al. | |
| 7,035,791 | B2 | 4/2006 | Chazan et al. | |
| 8,358,563 | B2 | 1/2013 | Hiroe | |
| 8,639,502 | B1 | 1/2014 | Boucheron et al. | |
| 2002/0181711 | A1 | 12/2002 | Logan et al. | |
| 2003/0043116 | A1 | 3/2003 | Morrison et al. | |
| 2004/0220804 | A1 | 11/2004 | Odell | |
| 2005/0131680 | A1 | 6/2005 | Chazan et al. | |
| 2006/0020958 | A1 | 1/2006 | Allamanche et al. | |
| 2008/0298599 | A1 | 12/2008 | Kim | |
| 2009/0086998 | A1 | 4/2009 | Jeong et al. | |
| 2009/0177468 | A1 | 4/2009 | Yu et al. | |

OTHER PUBLICATIONS

Boucheron, et al., "Low Bit-Rate Speech Coding through Quantization of Mel-Frequency Cepstral Coefficients", in part, Data Compression Conference (DCC) 2011, Mar. 29, 2011.

Boucheron, et al., "Low Bit-Rate Speech Coding through Quantization of Mel-Frequency Cepstral Coefficients", in partm Int. Conf. Signals and Electronic Systems (ICSES), 2008.

Boucheron, et al., "On the Inversion of Mel-Frequency Cepstral Coefficients for Speech Enhancement Applications", International Conference on Signals and Electronic Systems, Sep. 16, 2008.

Chazan, et al., "Speech Reconstruction from Mel Frequency Cepstral Coefficients and Pitch Frequency", Proc. ICASSP, vol. 3, 2000, 1299-1302.

Lee, et al., "A MFCC-based CELP Speech Coder for Server-based Speech Recognition in Network Environments", Proc. European Conference on Speech Communication and Technology (INTERSPEECH), 2005, 1369-1372.

Lyon, et al., "Sound Retrieval and Ranking Using Sparse Auditory Representation", Sep. 2010.

Milner, et al., "Prediction of Fundamental Frequency and Voicing from Mel-Frequency Cepstral Coefficients for Unconstrained Speech Reconstruction", IEEE Transactions on Audio, Speech, and Language Processing, 2007, 24-33.

Ramaswamy, et al., "Compression of acoustic features for speech recognition in network environments", Proc. ICASSP, 1998, 977-980.

* cited by examiner

| Bitrate | Overlap | Bits/ Frame | Energy (Coeff 1) | Formant (Coeffs 2-14) | Pitch (Coeffs 15-70) | # Interp. Frames | Equivalent Overlap |
|---|---|---|---|---|---|---|---|
| 600 bps | 0% | 18 | 4-bit SQ | 14-bit VQ | | 7 | 87.5% |
| 1200 bps | 25% | 27 | 4-bit SQ | 14-bit VQ | 9-bit VQ | 3 | 81.25% |
| 2400 bps | 25% | 54 | 4-bit SQ | 14-bit VQ (Coeffs 2-6)<br>14-bit VQ (Coeffs 7-14) | 14-bit VQ (Coeffs 15-30)<br>8-bit VQ (Coeffs 31-70) | 3 | 81.25% |
| 4800 bps | 25% | 108 | 4-bit SQ | 14-bit VQ (Coeffs 2-4)<br>14-bit VQ (Coeffs 5-7)<br>14-bit VQ (Coeffs 8-10)<br>14-bit VQ (Coeffs 11-14) | 14-bit VQ (Coeffs 15-22)<br>14-bit VQ (Coeffs 23-30)<br>10-bit VQ (Coeffs 31-50)<br>10-bit VQ (Coeffs 51-70) | 3 | 81.25% |

FIG. 6

LOW BIT-RATE SPEECH CODING THROUGH QUANTIZATION OF MEL-FREQUENCY CEPSTRAL COEFFICIENTS

CROSS-REFERENCE TO RELATED APPLICATIONS

This application is a continuation of U.S. patent application Ser. No. 13/329,976, entitled "Low Bit-Rate Speech Coding Through Quantization of Mel-Frequency Cepstral Coefficients", filed Dec. 19, 2011, which claims priority to and the benefit of the filing of U.S. Provisional Patent Application Ser. No. 61/424,525, entitled "Low Bit-Rate Speech Coding through Quantization of Mel-Frequency Cepstral Coefficients", filed on Dec. 17, 2010, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to speech codec methods, apparatuses, and non-transitory storage media comprising computer software.

Description of Related Art

Reconstruction of the speech waveform from mel-frequency cepstral coefficients (MFCCs) is a challenging problem due to losses imposed by discarding the phase spectrum and the mel-scale weighting functions. Among the earliest investigations for reconstruction of a speech waveform from MFCCs can be found in D. Chazan, R. Hoory, G. Cohen, and M. Zibulski, "Speech reconstruction from mel frequenecy cepstral coefficients and pitch frequency," in Proc. ICASSP, vol. 3,2000, pp. 1299-1302. In embodiments of the present invention, an MFCC-based codec is used in distributed speech recognition (DSR) where MFCC feature vectors are extracted and quantized by the client before transmission over the network. This approach reduces system complexity since an alternate codec would require server-side decoding and extraction of MFCCs before ASR—with an MFCC-based codec, these latter two steps are unnecessary. As described in G. N. Ramaswamy and P. S. Gopalakrishnan, "Compression of acoustic features for speech recognition in network environments," in Proc. ICASSP, 1998, pp. 977-980, a bit rate of 4000 bps did not impair speech recognition rates. A technique was proposed for reconstructing the speech waveform for purposes of "playback" by either client or server. The technique relies on sinusoidal synthesis whereby the MFCCs along with pitch and a voicing decision allow sinusoidal amplitudes, frequencies, and phases to be estimated and used in reconstruction. It was found that "natural sounding, good quality intelligible speech" can be reconstructed when 24 MFCCs per frame are used and pitch and voicing decision estimates are accurate.

The need to reconstruct speech from MFCCs gained further importance with an extension to the European Telecommunications Standards Institute (ETSI) Aurora distributed speech recognition (DSR) standard. This extension includes a provision whereby a time-domain speech signal may be reconstructed from the received MFCC vectors (transmitted over a 4800 bps channel) together with fundamental frequency and voicing information (transmitted over a 800 bps auxiliary channel) using sinusoidal synthesis. In potential applications of DSR, reconstruction of the speech waveform is important in cases of dispute arising from recognition errors or simply for human verification of transmitted utterances.

As described in B. Milner and X. Shao, "Prediction of fundamental frequency and voicing from mel-frequency cepstral coefficients for unconstrained speech reconstruction," vol. 15, no. 1, pp. 24-33, 2007, the authors investigated speech reconstruction solely from MFCC vectors. They estimated pitch and voicing from the MFCCs by exploiting correlation between the fundamental frequency and the spectral envelope. The primary result is a technique that can yield good predictions of pitch and voicing and when coupled with MFCC vectors, enabling speech reconstruction via sinusoidal synthesis similar to that described by D. Chazan et al. In their experiments, the authors use the ETSI Aurora standard of 13 MFCCs per vector extracted from a 25 ms speech frame at a rate of 100 vectors/s (uncoded). In informal listening tests, the authors report that "provided the fundamental frequency contour was smooth, then intelligible and reasonable quality speech can be reconstructed." Unfortunately, prediction accuracy of the fundamental frequency and voicing when using speaker independent models can be degraded. Therefore without formal subjective tests or objective quality measures, it is difficult to fully assess quality in the speech signal reconstructed from MFCCs through this approach.

As described in G. H. Lee, J. S. Yoon, and H. K. Kim, "A MFCC-based CELP coder for server-based speech recognition in network environments," in Proc. European Conference on Speech Communication and Technology (INTERSPEECH), 2005, pp. 1369-3172, the authors present a predictive vector quantization-based coding scheme for 13 MFCCs at 8700 bps, nearly twice the ETSI bitrate of 4800 bps. Speech reconstruction is accomplished by a conversion of MFCCs to linear prediction coefficients (LPCs) which are used to synthesize the speech waveform. The authors of that paper report equivalent PESQ scores to the G.729 standard.

The challenge in the reconstruction of speech from an MFCC-based feature extraction process normally used in ASR (13-20 MFCCs per frame) is that too much information is discarded to allow a simple reconstruction of a speech signal. In contrast, embodiments of the present invention reconstruct the speech waveform by directly inverting each of the steps involved in computing MFCCs. For the steps which impose losses, a least-squares (LS) inversion of the mel-scale weighting functions and an iterative LS phase estimation method are preferably used.

Embodiments of the present invention do not discard too much information and instead use a high-resolution MFC (large number of MFCCs per speech frame), thus eliminating the need for auxiliary computation of fundamental frequency as needed in other methods. There is thus a present need for a method and system that can encode at 4800 bps rates (compatible with the ETSI Aurora DSR standard) while at the same time enabling good quality, intelligible, reconstructed speech. There is further a need for a method, system, and apparatus that can easily downconvert to the low-resolution MFCC vector for compatibility with ASR, which produces a low-resolution MFCC vector that is measurably identical to that which is directly extracted from a speech signal, and satisfies the front-end DSR requirements. Namely, 1) ability to code MFCCs at standard bitrates, 2) a simple downconversion to lower dimensional MFCC vectors compatible with ASR, and 3) good-quality reconstruction of the speech waveform from the MFCCs. There is further a present need for a method, system, and apparatus which has a high resolution MFC that can be coded at bitrates as low as 600 bps, yielding speech quality approaching that of the state-of-the-art MELPe codec, thus at higher bitrates, the MFCC-based codec yields speech quality better than that of CELP-based codecs.

BRIEF SUMMARY OF THE INVENTION

The present invention is of a method of (and concomitant computer software embodied on a non-transitory computer-readable medium for) generating speech, comprising: receiving a mel-frequency cepstrum employing a set of weighting functions; generating a pseudo-inverse of the set; reconstructing a speech waveform from the cepstrum and the pseudo-inverse; and outputting sound corresponding to the waveform. In the preferred embodiment, the invention further comprises estimating a phase spectrum via least squares estimate, most preferably via least squares estimate using an inverse short-time Fourier transform magnitude method. The generating step preferably generates a Moore-Penrose pseudo-inverse of the set.

The invention is further of a method of (and concomitant computer software embodied on a non-transitory computer-readable medium for) encoding speech, comprising: receiving sounds comprising speech; computing mel-frequency cepstral coefficients from the sounds using a quantization method selected from the group consisting of non-uniform scalar quantization and vector quantization; and generating and storing codewords from the coefficients that permit recreation of the sounds. In one embodiment, computing comprises computing mel-frequency cepstral coefficients from the sounds using a non-uniform scalar quantization employing a Lloyd algorithm, most preferably resulting in a PESQ of 3.45 or higher using only four bits per coefficient. In another embodiment, computing comprises computing mel-frequency cepstral coefficients from the sounds using vector quantization, most preferably resulting in a PESQ of 2.5 or higher using sub-vectors of 14 or fewer bits each. The invention is preferably executed by a codec.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 6 is a table which illustrates the allocation of bits for VQ codec at different bitrates, in the chart, bitrate specifies the target bitrate, overlap is the percentage overlap used in analysis, bits/frame is the total number of bits available to code each resulting frame, energy, formant, and pitch specify the coding utilized for each subset of MFCCs, frames specifies the number of interpolated frames inserted prior to reconstruction, and equivalent overlap is the resulting equivalent overlap for the LSE-ISTFTM method.

DETAILED DESCRIPTION OF THE INVENTION

Figure 1A:
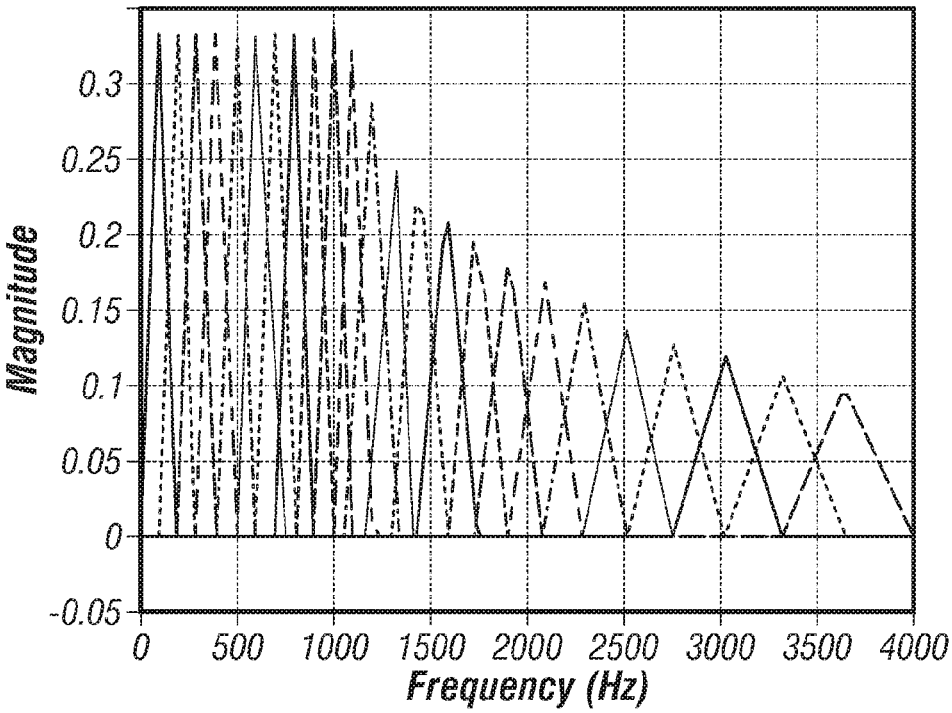
FIGS. 1A-C are graphs which illustrate effects of downconversion of high-resolution MFCCs using the proposed 70-band filterbank and an example 24-band low-resolution filterbank; resulting 24 mel-scale weighting functions are modified by less than 10% of their original values.

Embodiments of the present invention relate to a low bit-rate speech codec based on vector quantization (VQ) of the mel-frequency cepstral coefficients (MFCCs). In one embodiment, a high-resolution mel-frequency cepstrum (MFC) is computed; good-quality speech reconstruction is possible from the MFCCs despite the lack of phase information. By evaluating the contribution toward speech quality that individual MFCCs make and applying appropriate quantization, perceptual evaluation of speech quality (PESQ) of the MFCC-based codec exceeds the state-of-the-art MELPe codec across the entire range of 600-2400 bits per second. A codec according to an embodiment of the present invention permits enhanced distributed speech recognition (DSR) since the MFCCs can be directly applied, thus eliminating additional decode and feature extract stages.

In one embodiment of the present invention, computation of the cepstrum begins with the discrete Fourier transform (DFT) of a windowed speech signal s $$x_r[m]=s[rR+m]w[m] \tag{1}$$

where w is the length L window ($0 \le m \le L-1$), R is the window or frame advance in samples, and r denotes the frame index. For convenience, the speech frame is denoted as $$x=[x_r[0],x_r[1], \ldots ,x_r[L-1]]^T \tag{2}$$

(note that the subscript r has been dropped to simplify notation) and the spectrum as the Discrete Fourier Transform (DFT) of x $$X=\mathcal{F}\{x\}. \tag{3}$$

The cepstrum of x may be defined as $$C=\mathcal{F}^{-1}\{\log|X|\} \tag{4}$$

where the inverse discrete Fourier transform $F^{-1}$ is applied to the log-magnitude spectrum of x.

In the definition of Mel-Frequency Cepstral Coefficients (MFCCs) M a set of weighting functions φ is applied to the power spectrum prior to the Discrete Cosine Transform (DCT) and log operations $$M=\mathcal{DCT}\{\log \Phi|X|^2\}. \tag{5}$$

This weighting φ is based on human perception of pitch and is most commonly implemented in the form of a bank of filters each with a triangular frequency response. The mel-scale weighting functions $\varphi_j$, $0\le j\le J-1$ are generally derived from $J_1$ triangular weighting functions (filters) linearly-spaced from 0-1 kHz, and $J_2$ triangular weighting functions logarithmically-spaced over the remaining bandwidth (1-4 kHz for a sampling rate of 8 kHz), where $J_1+J_2=J$. Additionally, in embodiments of two "half-triangle" weighting functions centered at 0 and 4 kHz which are preferably included in $J_1$ and $J_2$ since these will directly affect the number of MFCCs. The use of the two "half-triangle" weighting functions improves the quality of the reconstructed speech waveform which is described in the next section. In usual implementations, J<L and thus this weighting may also be thought of as a perceptually-motivated dimensionality reduction.

The mel-weighted power spectrum in (5) can be expressed in matrix form as $$Y=\Phi|X|^2 \tag{6}$$

where Y is J×1, the weighting matrix φ is J×L and has columns φj, and $|X|^2$ is L×1.

The MFCCs are primarily used as features in speech processing and are not normally converted back to speech, however, an estimate of the speech frame can be made from the MFCCs. In (5), two sources of information loss occur: 1) application of the mel-scale weighting functions and 2) the phase spectrum is discarded in computing the power spectrum. Otherwise, the DCT, log, and square-root operations are all invertible. Thus, estimation of the speech frame from the MFCCs requires a pseudo-inverse of φ and an estimate of the phase spectrum.

1) Least-Squares Inversion of the Mel-Scale Weighting Functions: Since J<L an underdetermined problem is presented. In order to solve this problem, the Moore-Penrose pseudo-inverse $\varphi^{\dagger}=(\varphi^T\varphi)^{-1}\varphi^T$ is used to form a LS solution, i.e., the solution of minimal Euclidean norm, for $|X|^2$ as $$|\hat{X}|^2=\Phi^{\dagger}Y=\Phi^{\dagger}\Phi|X|^2\approx|X|^2. \tag{7}$$

2) Least-Squares Estimation of Speech Frame from Magnitude Spectrum: After pseudo-inversion of the mel-scale weighting functions, a magnitude spectrum is left from which the speech frame must be estimated. In order to compute the inverse transform, the phase spectrum is estimated since this is discarded during computation of the MFCCs. The speech frame (and hence the phase spectrum) can be estimated using the Least-Squares Estimate, Inverse Short-Time Fourier Transform Magnitude (LSE-ISTFTM) algorithm shown in Algorithm 1. The LSE-ISTFTM algorithm iteratively estimates the phase spectrum and couples this to the given magnitude spectrum resulting (after inverse transformation) in a time-domain estimate of the speech frame. The complete speech waveform is then reconstructed via an overlap-add procedure from the sequence of estimated speech frames.

Algorithm 1 Least-Squares Estimate (LSE), Inverse Short-Time Fourier Transform Magnitude (ISTFTM).

Given: Speech magnitude spectrum, $|\hat{X}|$ and desired number of iterations, M
Find: LSE speech frame for given magnitude spectrum, $\tilde{x}$ 1: Initialize $\tilde{x}$ to white noise
2: for m = 1 to M do
3: Compute $\mathcal{F}\{\tilde{x}\}=\tilde{X}=|\tilde{X}|e^{j\angle\tilde{X}}$
4: Let $\hat{X}=|\hat{X}|e^{j\angle\tilde{X}}$
5: Compute $\tilde{x}=\mathcal{F}^{-1}\{\hat{X}\}$
6: end for In most speech processing applications such as automatic speech recognition (ASR) which use MFCCs as features, e.g., the Hidden Markov Model Toolkit (HTK), the number of MFCCs extracted per speech frame is between 13 and 20. This is the motivation behind the establishment of a standard MFCC-based data channel for DSR.

As described below, an MFCC-based codec requires a much higher resolution mel-frequency cepstrum (more MFCCs per speech frame) in order to obtain good-quality speech reconstruction. Downconversion from a high-resolution MFCC vector to a low-resolution MFCC vector for feature compatibility with ASR systems is preferably used. The implementation of this conversion can be seen by reviewing (5). To recover the power spectrum, the DCT and log operations are preferably inverted before being left multiplied by pseudoinverse of the mel weighting matrix, $\varphi^{\dagger}$. A new, lower-dimension mel weighting matrix φ (K×L where K<J) is preferably applied, followed by the log and DCT operations.

Figure 1B:
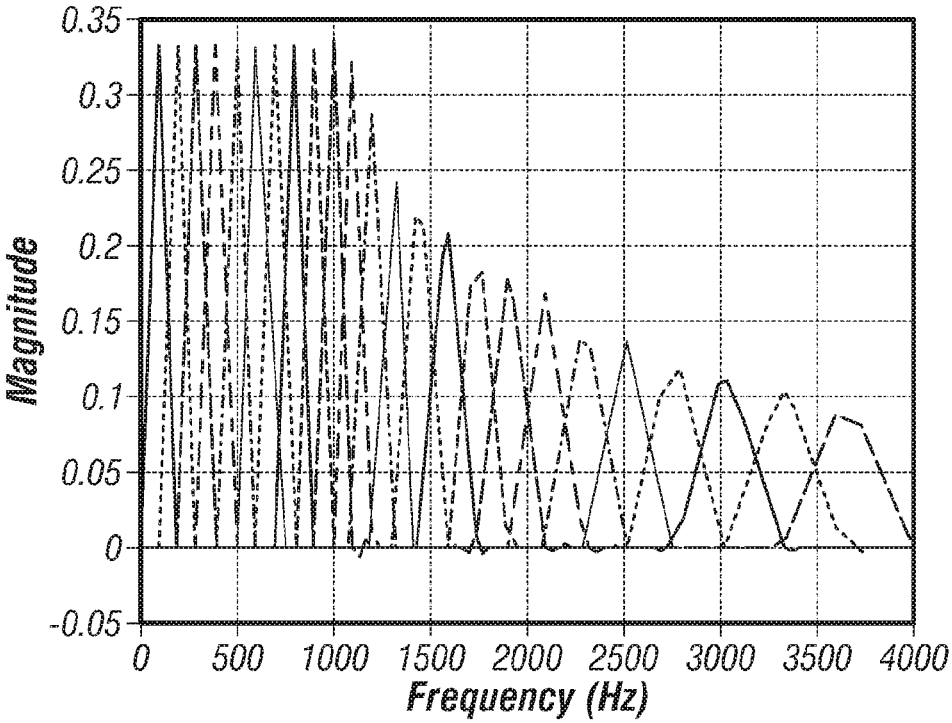
Figure 1C:
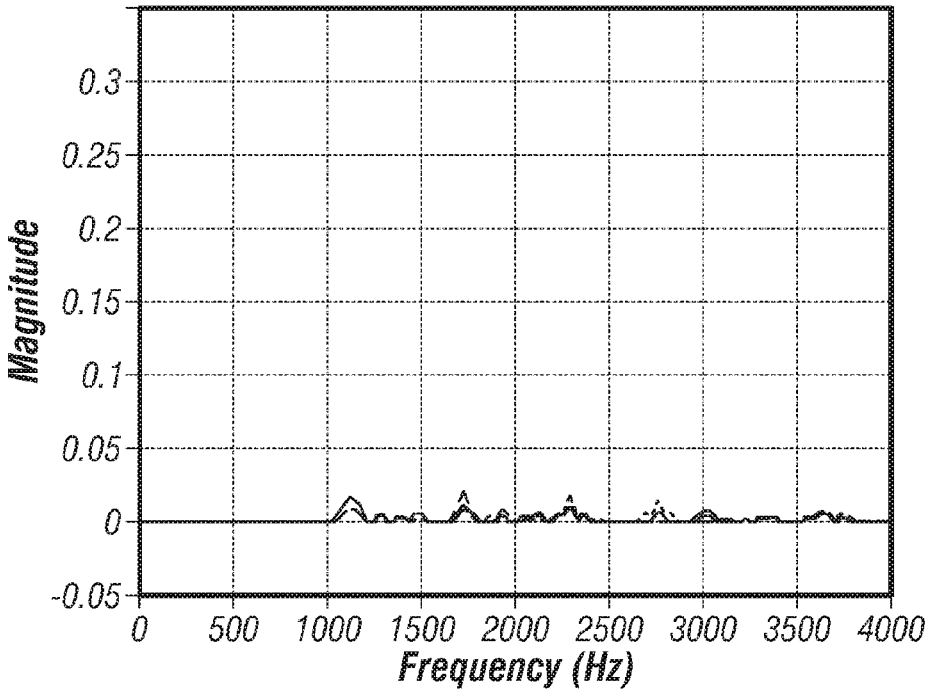

FIGS. 1A-C illustrate the effect of this downconversion process. FIG. 1A illustrates 24 mel-scale weighting functions, $\varphi_{24}$ similar to those commonly used for computation of 13 MFCCs (i.e., a 13-point DCT of the 24-channel log-magnitude spectrum). FIG. 1B illustrates the equivalent 24 mel-scale weighting functions when considering the downconversion from (for example) 70 MFCCs, i.e., $\varphi'_{24}=\varphi_{24}\varphi^{\dagger}_{70}\varphi_{70}$. For clarity, FIG. 1C displays the difference $|\varphi_{24}-\varphi^{\dagger}_{24}|$ where the 24 mel-scale weighting functions are modified by less than 10% of their original values.

Turning now to the quantification of the loss in speech quality when reconstructing a speech signal from MFCCs using the Perceptual Evaluation of Speech Quality (PESQ) measure, a brief discussion of the PESQ measure is now provided, followed by a discussion of the degradation in the reconstruction of speech due to the two above mentioned sources of information loss: least-squares inversion of the mel-scale weighting functions and least-squares estimation of the speech frame from the magnitude spectrum.

PESQ is an objective measure of speech quality developed to obtain the highest correlation with subjective Mean Opinion Scores (MOS) and was adopted by ITU-T as Recommendation P.862. Both clean reference and degraded signals are aligned to a common listening level, filtered with a standard IRS handset model, time aligned, and processed with a psychoacoustically motivated auditory transform. Disturbance measures are then computed to model the differences between the reference and degraded signals within this auditory transform and these disturbances are subjected to linear regression to best correlate to subjective MOS.

PESQ is considered to have "acceptable accuracy" for evaluation of waveform-based (PCM) and CELP-based codecs for bitrates less than 4000 bps. Applications for which PESQ has not been officially validated include artifacts of speech enhancement algorithms, artificial voices, CELP-based codecs less than 4000 bps, and non CELP-based codecs. However, PESQ has recently been evaluated against subjective quality scores for speech enhancement algorithms, and against word accuracy rate (WAR) for ASR and artificial voices. It has been found that PESQ have the highest correlation (Pearson's correlation coefficient $\rho=0.89$) with overall signal quality of any of the measures tested. A least-squares fit to the PESQ-WAR relationship provides a way to estimate WAR from PESQ; this estimator was found to have coefficient of determination $R^2=0.85$. The use of PESQ to compare artificial speech and real speech was found to have a coefficient of determination $R^2=0.92$, but note that PESQ for artificial speech is biased to be slightly higher ($\leq 0.2$).

In light of the foregoing, while PESQ may not have been specifically analyzed for speech quality evaluation of non-CELP-based codecs or low bitrate codecs, it has been shown to be a broadly applicable measure across a wide range of speech processing applications. Thus, in order to objectively measure quality of the proposed speech codec, embodiments of the present invention preferably use PESQ in addition to subjective listening tests.

Although the DCT, log, and square root operations in (5) are all invertible, a pseudo-inverse of the mel-scale weighting functions and a phase estimate (LSE-ISTFTM) are preferably used in order to complete the reconstruction of the speech frame; these two steps can impose quality losses. The quality of the reconstructed speech signal is preferably measured using the perceptual evaluation of speech quality (PESQ) metric. In one embodiment, PESQ results are averaged over a sample, for example 16 TIMIT speakers (8 female and 8 male) downsampled to a rate of $f_8=8000$ Hz; each signal is ~24 s in duration. A baseline PESQ score for the TIMIT reference signals is 4.5.

Figure 2:
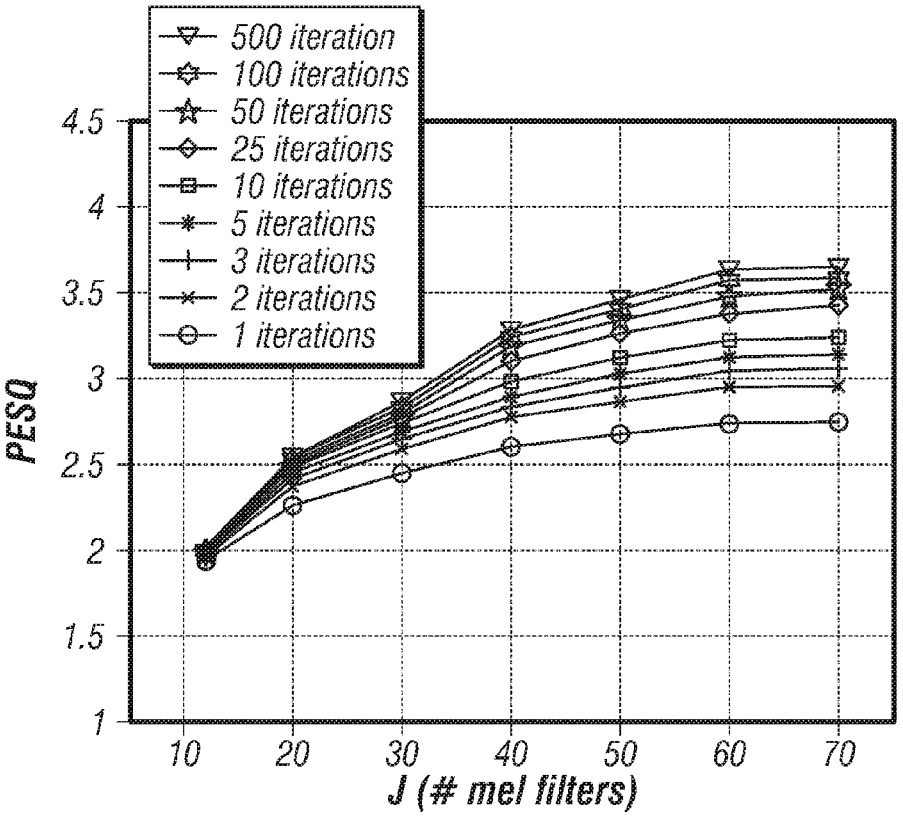
FIG. 2 is a graph which illustrates an inversion of MFCCs in a clean phase-less environment at a various number of iterations. These results are averaged for a sample of 16 TIMIT speakers.

In one embodiment, the MFCCs are computed as in (5) using a 240 sample (30 ms) Hamming window with a 120 sample frame advance (50% window overlap). Of course other sample sizes and rates can optionally be used and will provide desirable results. The number of MFCCs over 0-1 kHz, $J_1$ is preferably selected as follows. Set $J_1=30$ for $J\geq 60$ or for $J<60$, $J_1$ can be selected for highest PESQ ($J_1$=[7; 15; 20; 30; 30] for J=[10; 20; 30; 40; 50] respectively). The number of MFCCs over 1-8 kHz, $J_2=J-J_1$. For a 30 ms window length, the DFT resolution is preferably 33⅓ Hz, providing 30 frequency points over 0-1 kHz. Thus, for $J\geq 60$ there is no binning of the first 1 kHz; equivalently, the upper 30×30 block of $\phi$ is preferably identity. From the MFCCs, the speech waveform is preferably reconstructed using the method previously described. FIG. 2 illustrates the PESQ as a function of J (the number of MFCCs) for several different values of LSE-ISTFTM iterations.

The quality of the reconstructed speech signal from $J\geq 40$ MFCCs is fair (~3.25 PESQ MOS) and the number of LSE-ISTFTM iterations is preferably at least 50. With J=70 and 500 LSE-ISTFTM iterations, quality is fair/good (~3.6 PESQ MOS) and with fewer than 40 MFCCs, quality degrades rapidly. For a large number of MFCCs ($J\geq 40$), doubling the number of LSE-ISTFTM iterations results in small PESQ improvement (~0.1 PESQ MOS point). Thus, the quality of the reconstructed speech from MFCCs depends more on resolution (number of MFCCs) than the number of LSE-ISTFTM iterations. For practical implementation with a large number of MFCCs, 100 iterations provides a good balance between reconstruction quality and computation and yields a PESQ score within about 2% of the solution obtained with 500 iterations. In one embodiment, the LSE-ISTFTM algorithm with 100 iterations is preferably selected for all work and when evaluating the MFCC-based codec, a PESQ of 3.58 is used as a benchmark.

The foregoing outlines a procedure to reconstruct speech frames from MFCCs and measured signal degradation from the losses imposed by MFCC computation. A method for quantization of the MFCCs is now described for low bit-rate speech coding.

Figure 3:
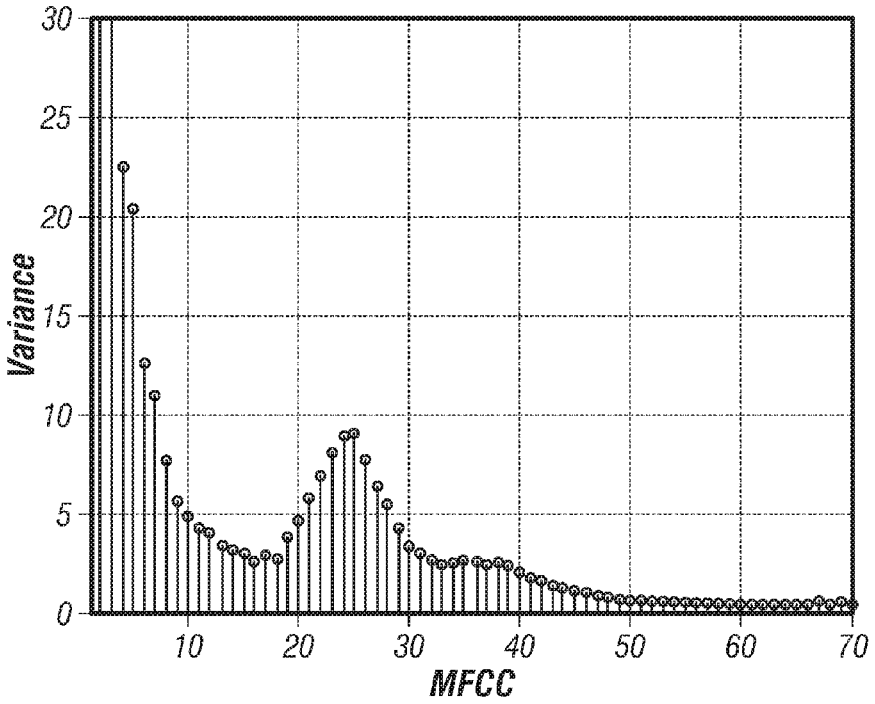
FIG. 3 is a graph which illustrates variance of individual MFCCs.

Simulation and PESQ evaluation illustrates that the individual MFCC variance is directly related to its contribution to speech quality. FIG. 3 illustrates a plot of the variance of individual MFCCs across the speech frames for the complete 630 speaker TIMIT corpus. A large variance is observed for the first seven MFCCs and smaller variance for coefficients in the approximate range of 8-30, when a total of 70 MFCCs are used. This is not unexpected given the direct correspondence of the initial part of the high-resolution MFCCs to formant structure and correspondence of middle coefficients to pitch period (i.e., vocal excitation) information. In the high-resolution MFC (70 coefficients), MFCCs 2-14 can be roughly partitioned as corresponding to formant structure and MFCCs 15-30 as corresponding to pitch. In this embodiment, the first MFCC corresponds to energy. It is the high-resolution aspect of these MFCCs that allows for direct modeling of the pitch information by the MFC. Since the initial 1 kHz of the spectrum is binned with a one-to-one correspondence, the harmonic structure of the pitch is maintained in the spectrum and converted by the DCT to the middle portion of the cepstrum. FIG. 3 thus suggests that more bits will have to be allocated to the few MFCCs corresponding to formant structure.

A non-uniform, scalar quantization (SQ) of the MFCCs is now discussed. The non-uniform quantization levels are determined using the Lloyd algorithm (k-means clustering). Allocating a fixed 4 bits per MFCC, which yields a bit rate of 4×70/0.015=18.667 bps, a PESQ of 3.45 can thus be realized—only about 0.13 PESQ MOS points below the reference which does not quantize the coefficients. This small degradation suggests 4 bits per MFCC are sufficient to code any MFCC with minimal loss.

In order to reduce the coding rate, reducing the number of bits per MFCC based on the variance is preferably used as previously discussed. Given a target bit rate, bits are preferably proportionally allocated to each MFCC according to the values illustrated in FIG. 3, allowing for a maximum of 4 bits and a minimum of 0 bits; in the latter case the MFCC are preferably constructed by using the coefficient's mean value (previously determined from speech data and stored in a lookup table at the decoder). Thus, the number of bits allocated to coefficient j is $$B_j = B\sigma_j^2 \Big/ \sum_k \sigma_k^2, \tag{8}$$

where B is the total number of bits per frame and $\sigma_j^2$ is the variance of the j-th MFCC. Bj is then rounded to an integer for implementation purposes.

Figure 4A:
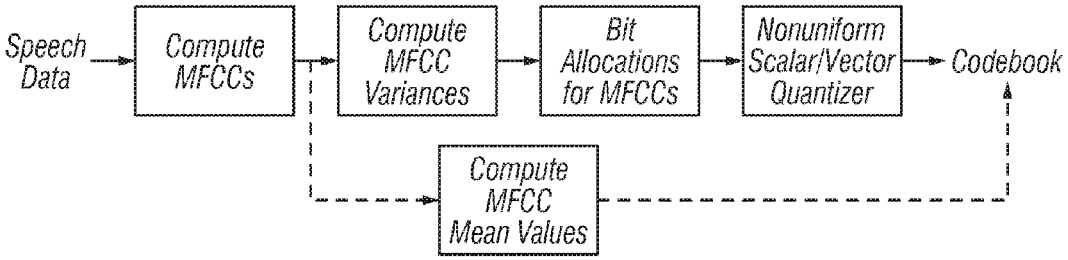
FIGS. 4A-C are flow charts which respectively illustrate computation of codebook where computation of the individual MFCC mean values is only used for scalar quantizer, an MFCC-based encoder, and an MFCC-based decoder where the reconstruction block includes both the LS inversion of the mel-scale weighting functions and the LSE-ISTFTM algorithm.
Figure 4B:
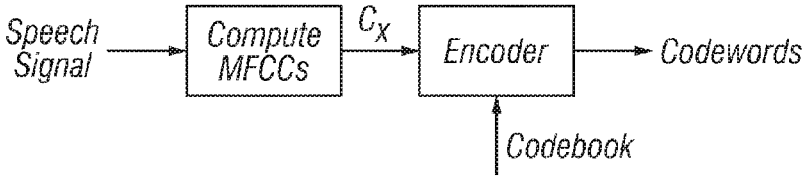
Figure 4C:
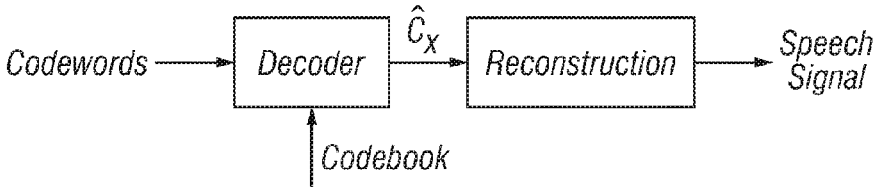

Computation of the codebook is illustrated in FIG. 4A, the blocks summarize the above information. In summary, from a set of speech data, high-resolution MFCCs, measure mean and variance of individual MFCCs, are computed to determine the bit allocations according to (8) for the given bit rate, and determine the scalar or vector quantization points, i.e. codewords. An encoder according to an embodiment of the present invention is illustrated in FIG. 4B, where the speech signal is windowed and MFCCs computed and codewords are output. Finally, the decoder is illustrated in FIG. 4C where codewords are decoded to MFCCs according to the codebook and the speech frame is reconstructed.

Figure 5:
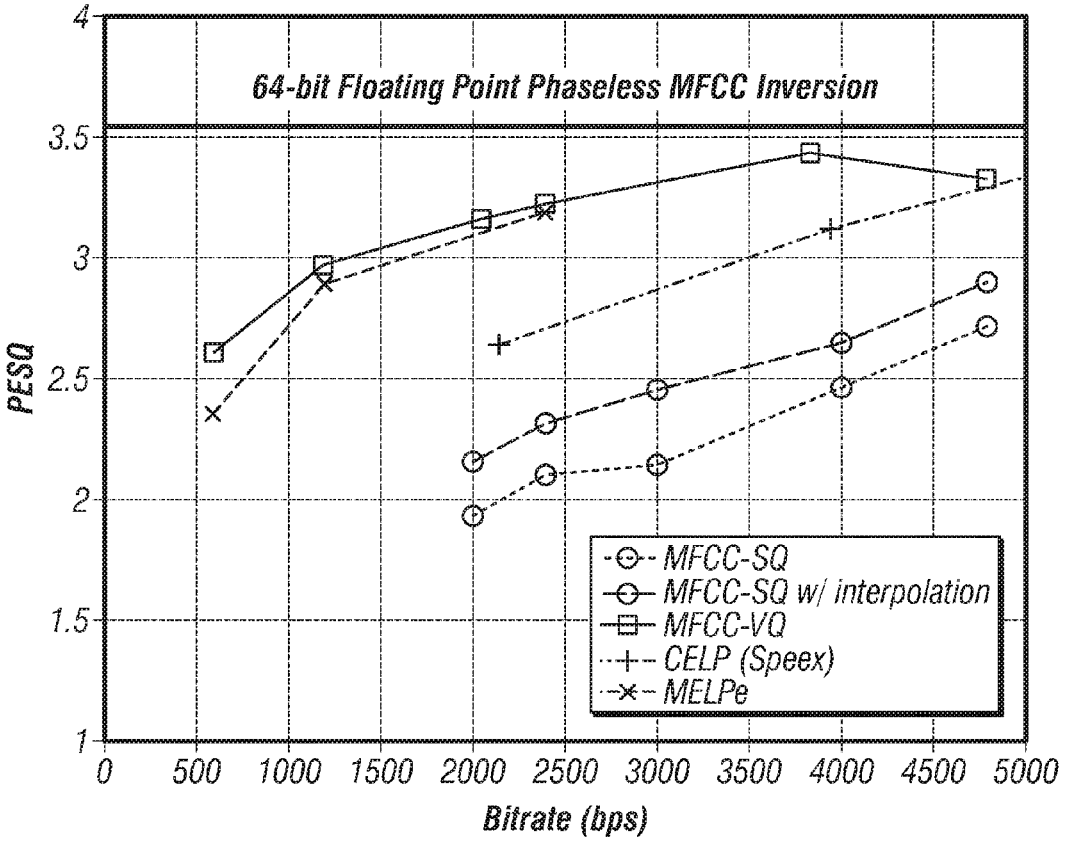
FIG. 5 is a graph which illustrates PESQ scores for various MFCC coding schemes and other low bitrate codecs which are averaged for the 16 TIM IT speakers.

The performance at various bitrates for the proposed nonuniform, scalar-quantized MFCC-codec is illustrated in FIG. 5. The reconstructed speech is intelligible, and the most noticeable distortion is a muffling effect during voiced speech segments. This muffling effect is most likely caused by inaccuracies in the estimation of phase information which worsens at lower bitrates. However, the reconstructed speech is free of the harsh synthetic sounds of many model-based codecs.

As an analysis tool, MFCCs are normally computed using overlapped windows in order to minimize edge effects. A typical value is 50% overlap as used in the SQ codec. Window overlaps other than 50% can allow for further improvement of the quality of low bitrate speech signals. The window overlap can have direct consequences for the quality of the quantized representation for a given bitrate (less overlap means more bits available for each frame) as well as for the quality of the LSE-ISTFTM algorithm (more overlap increases the redundancy used by the LSE method).

Empirically, it was determined that for the lowest bitrate (600 bps), it is better to decrease the window overlap and assign more bits to encode each MFCC vector and for higher bitrates (1200, 2400, 4800 bps) it is better to increase the window overlap and reduce the number of bits for each MFCC. In fact, at the lowest bit rate embodiments of the present invention can achieve the highest quality speech signals with no window overlap.

Interestingly, in the case of small overlap, inserting interpolated frames can improve quality of the decoded speech. These inserted frames are the direct linear interpolation of the two adjacent frames and are used by the LSE-ISTFTM algorithm as if they were a normally computed speech frame. Each interpolated frame reduces the frame advance by a factor of about 2. FIG. 5 illustrates the effect of inserting three interpolated frames for the SQ (dashed circle line). In this embodiment, recalling that the original signal was computed with 50% overlap, this is an approximation to a signal that was computed for 87.5% overlap. The redundancy of the interpolated frame likely improves in the inversion process of the LSE-ISTFTM algorithm which is a large source of quality loss.

Turning now to vector quantization (VQ) of the MFCCs, VQ can produce superior performance over SQ even when the components of the input vector are statistically independent. Computation and memory can, however, prove to be limiting factors when determining large number, for example more than $2^{14}$, VQ points, using fast k-means. Thus, the 70-dimensional MFCC vector is optionally partitioned into subvectors each coded with no more than about 14 bits each. The number of subvectors can be determined by the bitrate (higher bit rates allowed more bits per frame and hence more subvectors). As a result, MFCC vectors are preferably encoded at different bitrates, as illustrated in the table of FIG. 6. For example, at 1200 bps with a 25% window overlap, a total of 27 bits are available to encode each MFCC vector. The 1st coefficient which is related to energy and has the highest variance of any MFCC is encoded using 4 bit SQ, coefficients 2-14 which contain formant information are encoded using 14 bit VQ, and coefficients 15-70 which contain pitch information are preferably encoded using 9 bit VQ. Interpolated frames can be inserted prior to the reconstruction of the waveform with the LSE-ISTFTM algorithm; these values are listed in the table of FIG. 6, along with the equivalent reconstruction overlap. It should be noted that the coefficient means (shown in FIG. 5) are not required for the VQ, as no coefficients are allocated 0 bits as in the SQ coder.

The performance of the VQ codec is improved over the SQ codec, especially at low bitrates as illustrated in FIG. 5. Additionally, PESQ scores above 2.5 can be achieved for bitrates as low as 600 bps. Again, there is a muffling associated with the reconstructed speech, but clarity is improved over the SQ-based MFCC codec for all bit rates.

The proposed MFCC-based codec was compared to other low bitrate coding schemes, namely Mixed-Excitation Linear Predictive enhanced (MELPe) and Code-Excited Linear Prediction (CELP). The MELPe algorithm was derived using several enhancements to the original MELP algorithm. MELPe is also known as MIL-STD-3005 and NATO STANAG-4591 and supports bitrates of 1200 bps and 2400 bps. There also exists a proprietary 600 bps MELPe vocoder algorithm. Traditional LPC algorithms use either periodic pulse trains or white noise as excitation for a synthesis filter. The MELPe family of vocoders use a mixed-excitation model of the human voice and extensive lookup tables to extract and regenerate speech. The MELPe codec also utilizes a periodic pulse excitation, pulse dispersion to soften the synthetic sound of reconstructed speech, and adaptive spectral filtering to model the poles of the vocal tract. The MELPe codec is preferably further tuned to code the English language.

The CELP class of algorithms has been proven to work reliably as well as provide good scalability. Some examples of CELP-based standard codecs consist of G.728 which operates at 16 kbps and DoD CELP (Federal Standard 1016), which operates at 4.8 kbps. The open-source Speex codec, also based on CELP, operates at a variety of bitrates ranging from 2150 bps to 44 kbps. There are several aspects of human speech that cannot be modeled by traditional linear prediction coefficients (LPCs). This results in a difference between the original and reconstructed speech, which is referred to as the residue. CELP-based codecs first compute the LPCs and then calculate the residue. The residue is compared to a code book and the code word which best represents the residue is transmitted. A synthesis filter in the decoder utilizes the residue to more accurately synthesize speech.

The performance of CELP (Speex) and MELPe are illustrated in FIG. 5 for various bitrates between 600 and 4800 bps. The proposed MFCC-based codec yields PESQ scores better than both the Speex codec and state-of-the-art MELPe codec for bitrates ranging from 600 to 4800 bps. Although the decoded speech files coded with the MELPe and Speex codecs are intelligible, they are hindered by the artificial, synthetic-sounding speech common to many formant based synthesis systems, especially when encoding at the each codec's minimum bitrates. In contrast, the MFCC-based approach generates more natural sounding speech, but contains raspy and scratchy artifacts.

It should be noted that the ETSI DSR standard targets a 4800 bps codec, with the possibility of an additional 800 bps for auxiliary information (5600 bps total). It is clear from these results, that while the proposed MFCC codec requires a higher resolution MFC than proposed by ETSI, a bitrate well within the ETSI allocation can be achieved and reasonable quality speech can be reconstructed. To the best of the authors' knowledge, there are no published results for quality of the reconstructed speech using the ETSI proposed backend speech reconstruction algorithm. It should be noted, however, that the ETSI standard bitrate includes error control coding, while all other codecs discussed in this section do not.

In summary, a method, system and apparatus are provided to reconstruct a speech frame from a high-resolution mel-frequency cepstrum which relies on a pseudo-inverse of the mel-weighting functions and a phase estimate provided by the LSE-ISTFTM algorithm. Reconstruction of the speech waveform from MFCCs results in quality degradation of approximately one PESQ MOS point but nonetheless still leads to fair/good quality speech (~3.6 PESQ MOS). These degradations, however, are outweighed by quantization noise in the proposed low bitrate speech codec. The proposed codec, which is based on a VQ of the MFCCs, is preferably scalable down to low bitrates. Embodiments of the present invention have PESQ better than the CELP and state-of-the-art MELPe codecs. The proposed MFCC-based codec results in more natural sounding speech than those of existing codecs without the synthetic sounding artifacts. Finally, use of an MFCC-based codec can facilitate speech processing algorithms which use MFCCs such as distributed speech recognition applications.

In the preferred embodiment, and as readily understood by one of ordinary skill in the art, the apparatus according to the invention will include a general or specific purpose computer or distributed system programmed with computer software implementing the steps described above, which computer software may be in any appropriate computer language, including C++, FORTRAN, BASIC, Java, assembly language, microcode, distributed programming languages, etc. The apparatus may also include a plurality of such computers/distributed systems (e.g., connected over the Internet and/or one or more intranets) in a variety of hardware implementations. For example, data processing can be performed by an appropriately programmed microprocessor, computing cloud, Application Specific Integrated Circuit (ASIC), Field Programmable Gate Array (FPGA), or the like, in conjunction with appropriate memory, network, and bus elements.

Note that in the specification and claims, "about" or "approximately" means within twenty percent (20%) of the numerical amount cited. All computer software disclosed herein may be embodied on any non-transitory computer-readable medium (including combinations of mediums), including without limitation CD-ROMs, DVD-ROMs, hard drives (local or network storage device), USB keys, other removable drives, ROM, and firmware.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of encoding and decoding speech, the method comprising the steps of:

receiving sounds comprising speech;

computing 40 or more non-derivative mel-frequency cepstral coefficients per frame from the sounds using a quantization method selected from the group consisting of non-uniform scalar quantization and vector quantization;

generating and storing codewords from the coefficients that permit recreation of the sounds;

wherein the computing step comprises computing mel-frequency cepstral coefficients from the sounds using a non-uniform scalar quantization employing a Lloyd algorithm, resulting in a PESQ of 3.45 or higher using only four bits per coefficient; and decoding the codewords to create mel-frequency cepstral coefficients by inserting interpolated frames to improve quality; and after inserting the interpolated frames, reconstructing the speech based on the created mel-frequency cepstral coefficients.

2. The method of claim 1 wherein the method is executed by a codec.

3. A non-transitory computer-readable medium comprising computer software for encoding and decoding speech, said software comprising:

code receiving sounds comprising speech;

code computing forty or more non-derivative mel-frequency cepstral coefficients per frame from the sounds using a quantization method selected from the group consisting of non-uniform scalar quantization and vector quantization;

code generating and storing codewords from the coefficients that permit recreation of the sounds;

wherein said computing code comprises code computing mel-frequency cepstral coefficients from the sounds using a non-uniform scalar quantization employing a Lloyd algorithm, providing a PESQ of 3.45 or higher using only four bits per coefficient; and code decoding the codewords to create mel-frequency cepstral coefficients by inserting interpolated frames to improve quality; and code which, after inserting the interpolated frames, reconstructs the speech based on the created mel-frequency cepstral coefficients.

4. The medium of claim 3 wherein all said code is provided in a codec.

5. A method of encoding and decoding speech, the method comprising the steps of:

receiving sounds comprising speech;

computing 40 or more non-derivative mel-frequency cepstral coefficients per frame from the sounds using a quantization method selected from the group consisting of non-uniform scalar quantization and vector quantization;

generating and storing codewords from the coefficients that permit recreation of the sounds;

wherein the computing step comprises computing mel-frequency cepstral coefficients from the sounds using vector quantization, resulting in a PESQ of 2.5 or higher using sub-vectors of 14 or fewer bits each; and decoding the codewords to create mel-frequency cepstral coefficients by inserting interpolated frames to improve quality; and after inserting the interpolated frames, reconstructing the speech based on the created mel-frequency cepstral coefficients.

6. The method of claim 5 wherein the method is executed by a codec.

7. A non-transitory computer-readable medium comprising computer software for encoding and decoding speech, said software comprising:

code receiving sounds comprising speech;

code computing forty or more non-derivative mel-frequency cepstral coefficients per frame from the sounds using a quantization method selected from the group consisting of non-uniform scalar quantization and vector quantization;

code generating and storing codewords from the coefficients that permit recreation of the sounds;

wherein said computing code comprises code computing mel-frequency cepstral coefficients from the sounds using vector quantization, providing a PESQ of 2.5 or higher using sub-vectors of 14 or fewer bits each; and code decoding the codewords to create mel-frequency cepstral coefficients by inserting interpolated frames to improve quality; and code which, after inserting the interpolated frames, reconstructs the speech based on the created mel-frequency cepstral coefficients.

8. The medium of claim 7 wherein all said code is provided in a codec.

* * * * *